US005660223A

United States Patent [19]

Thieman et al.

[11] Patent Number: 5,660,223

[45] Date of Patent: Aug. 26, 1997

[54] VERTICAL DIE CASTING PRESS WITH INDEXING SHOT SLEEVES

[75] Inventors: Ted H. Thieman; Richard J. Kamm, both of Dayton, Ohio

[73] Assignee: THT Presses Inc., Dayton, Ohio

[21] Appl. No.: 559,633

[22] Filed: Nov. 20, 1995

[51] Int. Cl.[6] ..... B22D 17/12; B22D 17/30; B22D 19/00

[52] U.S. Cl. ..... 164/314; 164/312; 164/333

[58] Field of Search ..... 164/312, 314, 164/109, 113, 333, 332, DIG. 10

[56] References Cited

U.S. PATENT DOCUMENTS

| | | | |
|---|---|---|---|
| 2,938,250 | 5/1960 | Larsh et al. . | |
| 3,315,315 | 4/1967 | Triulzi | 164/333 X |
| 3,584,345 | 6/1971 | Beastrom | 164/113 X |
| 3,608,622 | 9/1971 | Bachelier | 164/333 X |
| 3,826,302 | 7/1974 | Wunder | 164/312 |
| 4,064,928 | 12/1977 | Wunder | 164/312 X |
| 4,842,038 | 6/1989 | Fujino et al. | 164/312 X |
| 5,127,467 | 7/1992 | Ueno | 164/312 X |
| 5,429,175 | 7/1995 | Thieman et al. . | |

FOREIGN PATENT DOCUMENTS

| | | | |
|---|---|---|---|
| 63-303671 | 12/1988 | Japan | 164/113 |
| 2-37260 | 8/1990 | Japan | 164/312 |

*Primary Examiner*—J. Reed Batten, Jr.
*Attorney, Agent, or Firm*—Jacox, Meckstroth & Jenkins

[57] ABSTRACT

A vertical frame supports a rotary indexing table which carries a pair of vertical shot sleeves each having a shot piston with a depending shot piston rod. The shot sleeves are alternately indexed between a metal receiving station and a metal transfer station where a mold is supported above the table by a gate plate mounted on the frame. A hydraulic ejection cylinder and a substantially larger hydraulic shot cylinder are supported by the frame under the metal receiving and transfer stations, respectively, and laterally sliding couplings alternately connect the shot piston rods to the hydraulic cylinders when the table is indexed 180°. Each shot piston and the gate plate form a biscuit which is retracted into the shot sleeve at the transfer station by the shot cylinder and is ejected at the receiving station by the ejection cylinder after the table and shot sleeves are indexed.

20 Claims, 3 Drawing Sheets

VERTICAL DIE CASTING PRESS WITH INDEXING SHOT SLEEVES

BACKGROUND OF THE INVENTION

This invention relates to a vertical die casting machine or press of the general type disclosed in U.S. Pat. No. 5,429,175 which issued to the assignee of the present invention. In such a press, or a press as disclosed in U.S. Pat. No. 2,938,250, molten aluminum or metal is poured or injected into a shot sleeve above a shot piston which is connected to the piston rod of a vertical hydraulic shot cylinder. A mold is supported above the shot sleeve and defines one or more cavities which receive the molten metal from the shot sleeve when the shot piston is elevated by the hydraulic shot cylinder. The mold is formed in multiple sections and is held in a closed position by a vertical hydraulic clamping cylinder supported by the frame above the mold.

In order to obtain higher volume production, applicants' assignee has produced a vertical die casting press with two parallel spaced shot cylinders and corresponding shot sleeves and pistons which are shifted horizontally back and forth between a molten metal receiving or pour station and a metal transfer station where the molten metal is forced upwardly from each shot sleeve by its corresponding shot piston and shot cylinder into the mold cavity. With such an arrangement, one shot sleeve may be receiving molten metal at the pour station while simultaneously the molten metal is being pressed from the other shot sleeve into the mold cavity at the transfer station. However, the reciprocating movement or shuttle of the two vertical shot cylinders and the corresponding shot sleeves and pistons is relatively slow due to the mass of these components. As a result, it is difficult to obtain rapid transfer of the molten metal and high quality die cast parts without porosity. In addition, the movement of the hydraulic shot cylinders requires flexible hydraulic lines and significant maintenance.

SUMMARY OF THE INVENTION

The present invention is directed to an improved die casting machine or press which is capable of operating at a higher speed and with a shorter cycle time than previously known die casting presses and which, as a result, produces higher quality parts without porosity. The die casting press of the invention is also simpler and less expensive in construction, requires less maintenance and is more convenient to service.

In accordance with one embodiment of the present invention, a vertical die casting press includes a frame having a base supporting a vertical pedestal or post on which is mounted a rotary indexing table. The table supports a pair of diametrically opposite shot sleeves each of which receives a shot piston connected to a downwardly projecting piston rod. A gate plate extends horizontally between the side walls of the frame and above the indexing table for supporting a lower mold section defining a cavity. When the table is indexed in steps of 180°, the shot sleeves are alternately located at a metal receiving or pour station and a metal injecting or transfer station under the gate plate. A hydraulic clamping cylinder is supported by the frame above the transfer station and moves an upper mold section vertically above the lower mold section.

A high pressure hydraulic shot cylinder is mounted on the base under the transfer station, and a substantially smaller hydraulic ejection cylinder is mounted on the base under the metal receiving or pour station. Each of the hydraulic cylinders has a non-rotating vertical piston rod which carries a set of spaced coupling plates. Each set of plates defines laterally extending and opposing undercut grooves for slidably receiving an outwardly projecting bottom flange on each of the shot piston rods. Thus when the rotary table is indexed, the shot piston rods rotate with the shot sleeves and alternately engage the piston rods of the two fixed hydraulic shot and ejection cylinders.

The hydraulic shot cylinder is actuated for transferring the molten metal from each shot cylinder upwardly into the cavity defined by the clamped mold sections. The shot cylinder then retracts the connected sprues or biscuit downwardly into the shot sleeve after the metal has partially solidified within the gate plate. After the table is indexed 180°, the smaller hydraulic ejection cylinder is actuated for ejecting the biscuit upwardly to the top of the indexing table where the biscuit is discharged laterally by an ejector head connected to a laterally extending fluid cylinder.

Other features and advantages of the invention will be apparent from the following description, the accompanying drawings and the appended claims.

DESCRIPTION OF THE PREFERRED EMBODIMENT

Figure 1:
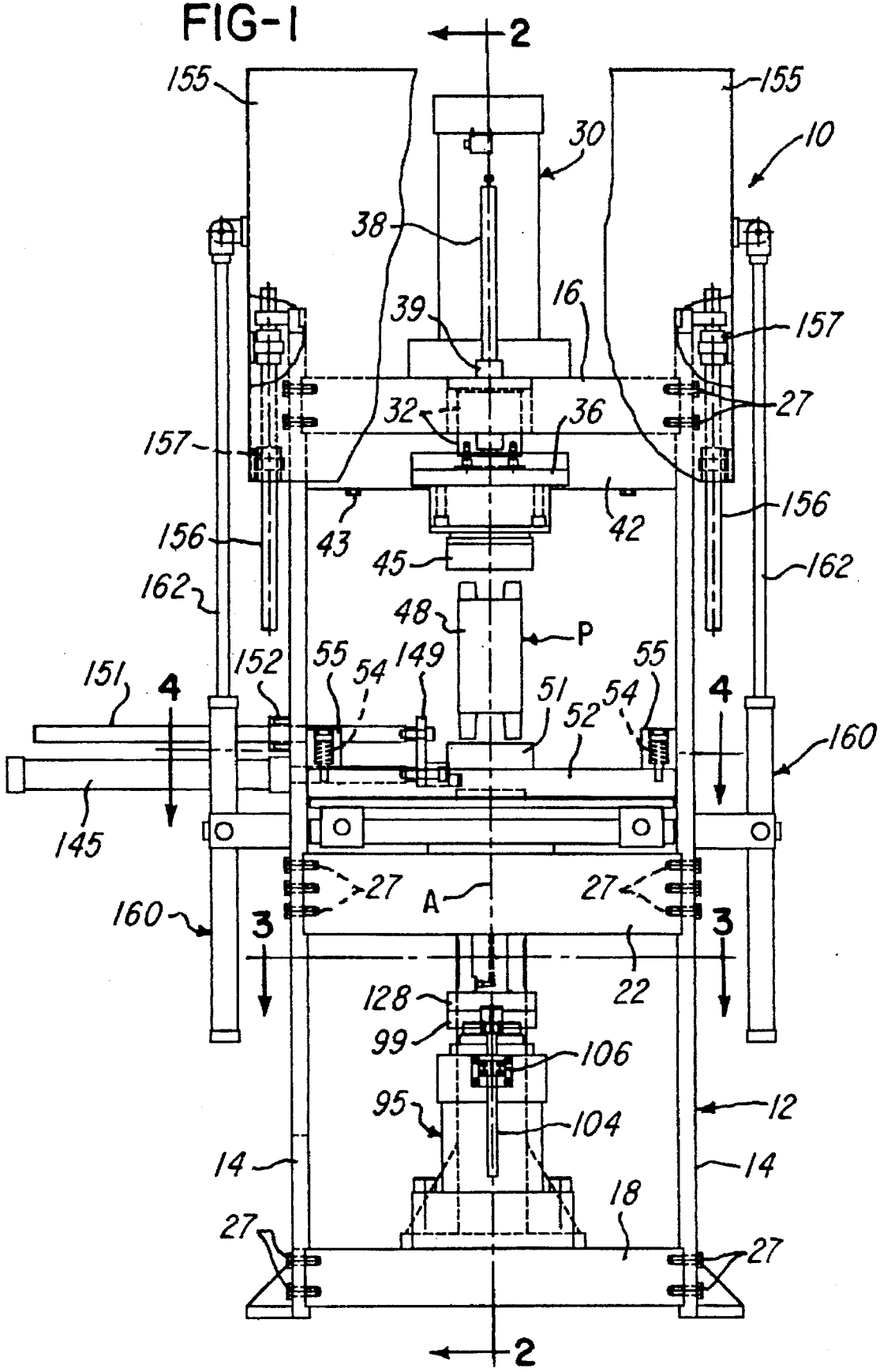
FIG. 1 is a front elevational view of a vertical die casting press constructed in accordance with the invention and with a portion of a safety gate broken away.
Figure 2:
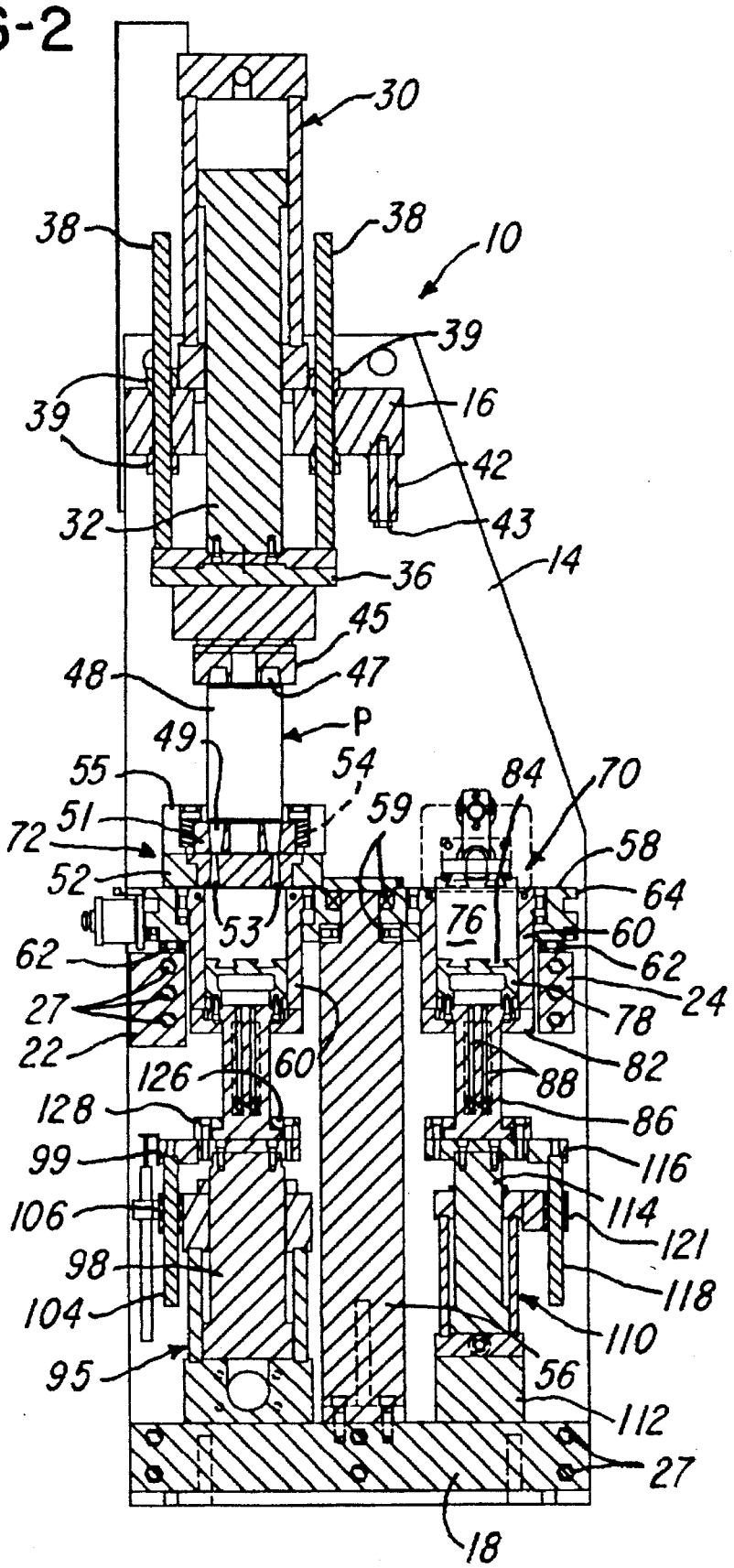
FIG. 2 is a vertical section of the die casting press, taken generally on the line 2—2 of FIG. 1.

Referring to FIGS. 1 and 2, a vertical die casting machine or press 10 includes a frame 12 formed by a pair of parallel spaced vertical side walls of plates 14 rigidly connected by a top plate 16, a base or bottom plate 18 and a set of intermediate cross plates or bars 22 and 24 (FIG. 2) all rigidly secured to the side plates 14 by a series of machine screws 27. The top cross plate 16 supports an upper double acting hydraulic clamping cylinder 30 having a piston rod 32 projecting downwardly on the vertical axis A of the press. The piston rod 32 carries a circular bottom plate 36, and the piston rod 32 and plate 36 are stabilized and prevented from rotating by a pair of guide rods 38 (FIG. 2) which extend upwardly through corresponding sets of guide bushings 39 within the top plate 16. A reinforcing bar or plate 42 (FIG. 2) extends under the rearward end portion of the top plate 16 and is secured to the top plate 16 by a set of screws 43.

An upper mold section 45 is connected or secured to the bottom surface of the plate 36 and defines an annular cavity 47 for forming a portion of a die cast part P. For purpose of illustration, the part P is a rotor for an electric motor having a stack 48 of steel laminations. The laminations have aligned internal passages which connect the annular cavity 47 within the top mold section 45 to an annular cavity 49 within a bottom mold section 51 mounted on a gate plate 52. The gate plate 52 has an insert which defines a set of tapered sprue holes 53, and the gate plate 52 is supported by the frame 12 (FIG. 1) for slight downward movement against a set of compression springs 54 retained within bars 55 mounted on the frame walls 14. It is understood that the part P to be die cast in the corresponding mold sections 45 and 51 form no part of the present invention and that the part P may be any form of die cast article.

Referring to FIG. 2, a cylindrical vertical column or post 56 is secured to the center of the base plate 18 and projects upwardly to support a rotatable circular table 58 by a set of anti-friction bearings 59 mounted on a hub. The table 58 supports a pair of diametrically opposite cylindrical shot sleeves 60 which have parallel vertical axes. The table 58 is also supported by a set of thrust bearings 62 mounted on the cross bars or plates 22 and 24. The table 58 has peripheral gear teeth 64 (FIGS. 2 and 4) which engage a pinion 66 mounted on the upper end of a vertical shaft of an electric stepping motor 68. Actuation of the motor 68 is effective to index the table 58 in steps or increments of 180° for alternately presenting the pair of shot sleeves 60 between a molten metal receiving or pour station 70 and a metal ejecting or transfer station 72 located under the gate plate 52.

Each of the shot sleeves 60 define a cylindrical chamber 76 which receives a corresponding shot piston 78 retained within the chamber 76 by an annular bottom cap plate 82 for the shot sleeve. The upper end portion of each shot piston 78 has a pair of laterally extending and tapered dovetail slots 84 (FIGS. 2 and 4), and a shot piston rod 86 projects downwardly from each piston 78 and through the corresponding bottom cap plate 82. As shown in FIG. 2, each of the shot piston reds 86 is provided with internal passages 88 through which cooling fluid or water is circulated into the corresponding piston 78 when it is desired to cool the piston and the adjacent metal to form a biscuit (not shown) having integrally connected upwardly projecting pins formed by the sprue holes 53.

A double acting hydraulic shot cylinder 95 (FIG. 2) is mounted on the base plate 18 under the metal transfer station 72 and in vertical alignment on the axis A with the upper hydraulic cylinder 30. The cylinder 95 includes a piston and piston rod 98 which projects upwardly, and a guide plate 99 is secured to the upper end of the piston rod 98. The piston rod 98 is prevented from rotating by a guide rod 104 which is secured to the plate 99 and projects downwardly through a guide bushing 106 mounted on the hydraulic cylinder 95.

Another double acting hydraulic ejection cylinder 110 (FIG. 2) is substantially smaller than the cylinder 95 and is mounted on the base plate 18 by a spacer block 112. The cylinder 110 includes a piston and piston rod 114, and a plate 116 is secured to the upper end of the piston rod 114. A guide rod 118 projects downwardly from the plate 116 and through a guide bushing 121 mounted on the cylinder 110 to prevent rotation of the plate 116 and piston rod 114. The cylinder 110 is located in vertical axial alignment with each shot sleeve 60 when the sleeve is located at the metal receiving or pour station 70.

Figure 3:
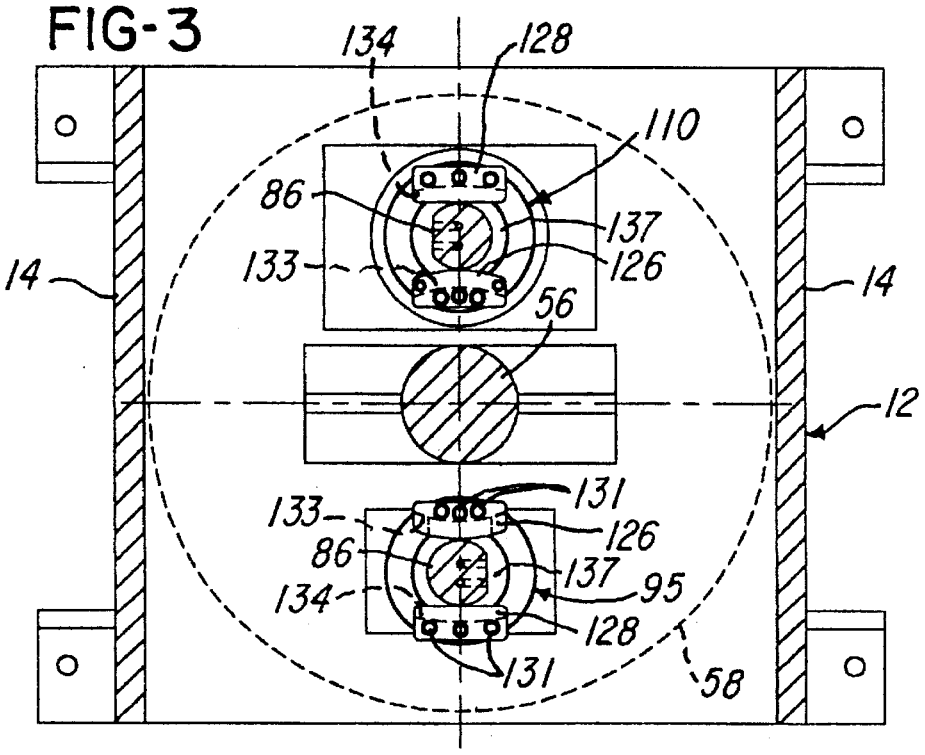
FIG. 3 is a horizontal section taken generally on the line 3—3 of FIG. 1.

Referring to FIG. 3, a set of spaced retaining or coupling plates 126 and 128 are secured to the upper surface of each of the guide plates 99 and 116 by a set of screws 131. Each set of coupling plates defines inner and outer opposing undercut slots 133 and 134 for slidably receiving an outwardly projecting circular flange 137 formed on the bottom of each shot piston rod 86. As apparent from FIG. 3, when the table 58 and shot sleeves 60 are indexed in steps of 180°, the shot piston rods 86 are alternately connected or coupled to the piston rods 98 and 114.

Figure 4:
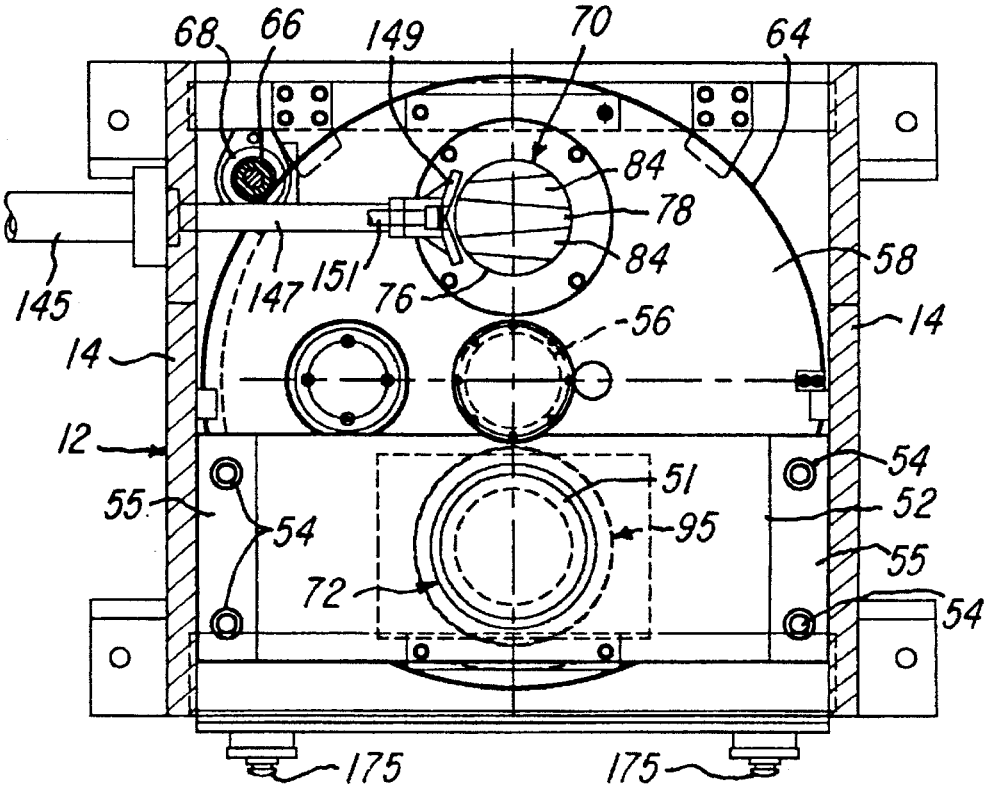
FIG. 4 is another horizontal section taken generally on the line 4—4 of FIG. 1.

As shown in FIG. 4, a double acting fluid or air cylinder 145 is mounted on the left side plate 14 of the frame 12 and includes a piston rod 147 which projects horizontally inwardly above the indexing table 58. An ejector head 149 is secured to the inner end portion of the piston rod 147 adjacent the metal receiving station 70 and is stabilized by a horizontal guide rod 151 extending through a bushing 152. When the cylinder 145 is actuated, the ejector head 149 is moved between its retracted position (FIG. 4) and an extended postion passing over the upper end surface of each shot piston 78 when it is located at the metal receiving station 70. As shown in FIG. 1, a safety gate 155 is supported by a pair of fixed vertical guide rods 156 and bushings 157 mounted on the gate 155 for vertical movement between an upper retracted position (FIG. 1) and a lower position (not shown) adjacent the gate plate 52. A pair of double acting fluid or air cylinders 160 are mounted on the frame 12 and have vertical piston rods 162 connected to move the safety gate 155.

In operation of the vertical die casting machine or press described above in connection with FIGS. 1–4, the rotor or part P is positioned between the upper mold section 45 and the lower mold section 51 after retraction of the hydraulic cylinder 30. A predetermined charge or shot of molten aluminum or metal is poured into a shot sleeve chamber 76 when the chamber is located at the metal receiving station 70. The cycle of the press is then started by depressing both of the start switches 175. The table 58 then indexes 180° to shift the shot of molten metal to the transfer station 72. When the table is indexed, each of the flanges 137 on the bottom ends of the shot piston rods 86, slides laterally from one set of opposing coupling plates 126 and 128 into coupling relation with the diametrically opposite set of coupling plates 126 and 128.

Thus after the first index of the table 58, the piston rod 86 projecting downwardly from the shot sleeve 60 which received the shot of molten metal, is coupled to the piston rod 98 of the shot cylinder 95. After the clamping cylinder 30 is actuated to clamp the mold sections together and to press the gate plate 52 downwardly against the table 58, the shot cylinder 95 is actuated so that the piston rod 98 moves upwardly to force the molten metal upwardly through the sprue holes 53 within the gate plate insert and then to the connected cavities 47 and 49 at opposite end of the rotor P. After the transferred molten metal partially solidifies within the cavities 47 and 49 and within the axially extending connecting passages (not shown) within the rotor P, the piston rod 98 is retracted downwardly The downward movement of the piston 78 separates the partially solidified metal within the tapered sprue holes 53 from the metal within the lower cavity 49 and forms a biscuit (not shown) which remains attached to the piston 78 as a result of the undercut dovetail slots 84.

While a biscuit is being retracted into the chamber 76 at the metal transfer station 72, another charge or shot of molten metal is poured into the chamber 76 located at the metal receiving station 70. When the table 58 is indexed again by 180°, the biscuit transfers to the metal receiving station 70, and the fresh shot of molten metal transfers to the metal transfer station 72. During the transfer, the depending piston rods 86 interchange their coupled relation with the hydraulic cylinders 95 and 110.

When a biscuit arrives at the metal receiving station 70, the cylinder 110 is actuated to raise the piston rods 86 and 114 and move the biscuit upwardly until the bottom of the dovetail slots 84 is flush with the top of the table 58. The laterally extending fluid cylinder 145 is then actuated to extend the piston rod 147 horizontally so that the head 149 pushes the biscuit from the slots 84 and into a chute (not shown) which transfers the biscuit to a collecting container (not shown). After the piston rod 147 is retracted, the cycle is repeated again in order to produce the die cast motor rotors or parts P on a continuous basis.

From the drawings and the above description, it is apparent that a die casting machine or press constructed in accordance with the present invention, provides desirable features and advantages. For example, the fixed hydraulic shot cylinder 95 and the fixed substantially smaller hydraulic ejection cylinder 110 substantially simplify the construction of the die casting press and thereby significantly reduce the manufacturing cost for the press. Only one large shot cylinder 95 is required, and the fixed positions of the hydraulic cylinders 95 and 110 permit the cylinders to be conveniently connected to hydraulic pumps and to be conveniently serviced during routine maintenance. In addition, the relative low mass of the rotatable components including the table 58, shot sleeves 22, pistons 78 and depending piston rods 86, provides for rapidly indexing the table 58 so that the molten metal received at the station 70 moves quickly to the transfer station 72. As a result, the press produces higher quality die cast parts without porosity. For example, when producing die cast rotor parts P, the table 58 may be indexed about every 15 seconds, and the shorter cycle time results in the production of higher quality die cast rotors.

While the form of die casting apparatus herein described constitutes a preferred embodiment of the invention, it is to be understood that the invention is not limited to this precise form of apparatus, and that changes may be made therein without departing from the scope and spirit of the invention as defined in the appended claims.

The invention having thus been described, the following is claimed:

1. A die casting press comprising a frame, a table supported by said frame for movement, a plurality of spaced shot sleeves supported by said table and having generally parallel spaced axes, a shot piston within each of said shot sleeves, a gate member positioned adjacent said table for supporting a mold defining a cavity, a power operated member for clamping the mold against said gate member, a power drive for moving said table to present each of said shot sleeves at a metal transfer station adjacent said gate member and a metal receiving station spaced from said metal transfer station, a shot cylinder positioned in general alignment with said metal transfer station and an ejector cylinder positioned in general alignment with said metal receiving station, and means for releasably connecting each of said shot pistons to each of said cylinders after moving of said table.

2. A die casting press as defined in claim 1 wherein said table is supported for rotary indexing on an axis, said connecting means include a shot piston rod projecting from each of said shot pistons for rotation with said table and said shot sleeves, and a releasable coupling for connecting each of said shot piston rods to each of said cylinders in response to indexing said table.

3. A die casting press as defined in claim 2 wherein said gate member is supported by said frame adjacent the circular path of said shot sleeves on said table.

4. A die casting press as defined in claim 1 wherein said connecting means comprise a laterally engagable coupling between each said shot piston and each said cylinder.

5. A die casting press as defined in claim 4 wherein each of said cylinders comprise a hydraulic cylinder having a piston rod, and means for preventing rotation of each said piston rod and the corresponding said coupling.

6. A die casting press as defined in claim 1 wherein said connecting means comprise a shot piston rod projecting from each said shot piston, each said cylinder comprises a hydraulic cylinder having a piston rod, and laterally engagable couplings alternately connecting each of said shot piston rods to each of said hydraulic cylinder piston rods.

7. A die casting press as defined in claim 1 wherein said table is supported for rotary indexing on an axis, and said shot sleeves are diametrically opposite on said table.

8. A die casting press as defined in claim 1 and including a fluid cylinder extending laterally from said metal receiving station adjacent said table, and said fluid cylinder including a piston rod supporting an ejector head for movement across each said shot sleeve at said metal receiving station for removing a solidified metal biscuit from each said shot piston.

9. A die casting press comprising a vertical frame, a table supported by said frame for movement in a generally horizontal plane, a plurality of spaced shot sleeves supported by said table and having generally vertical and parallel spaced axes, a shot piston within each of said shot sleeves, a support member positioned above said table for supporting a mold defining a cavity, a power operated member for clamping the mold against said support member, a power operated drive for moving said table to present each of said shot sleeves to a metal transfer station under said support member and then to a metal receiving station spaced horizontally from said metal transfer station, a fluid actuated shot cylinder positioned under said metal transfer station and a fluid actuated ejector cylinder positioned under said metal receiving station, and means including a releasable coupling for connecting each of said shot pistons to each of said fluid cylinders after moving said table.

10. A die casting press as defined in claim 9 wherein said table is supported for rotary indexing on a generally vertical axis, and said connecting means include a piston rod projecting downwardly from each of said shot pistons for rotation with said table and said shot sleeves.

11. A die casting press as defined in claim 10 wherein said support member is supported by said frame adjacent the circular path of said shot sleeves on said table.

12. A die casting press as defined in claim 9 wherein said connecting means comprise a laterally engagable coupling between each said shot piston and each said cylinder.

13. A die casting press as defined in claim 12 wherein each of said cylinders comprise a hydraulic cylinder having a piston rod, and means for preventing rotation of each said piston rod and the corresponding said coupling.

14. A die casting press as defined in claim 9 and including a shot piston rod projecting downwardly from each said shot piston, each said fluid cylinder comprises a hydraulic cylinder having an upwardly projecting piston rod, and laterally engagable couplings alternately connecting each of said shot piston rods to each of said hydraulic cylinder piston rods.

15. A die casting press as defined in claim 9 wherein said table is supported for rotary indexing on an axis, and said shot sleeves are diametrically opposite on said table.

16. A die casting press as defined in claim 9 and including a fluid cylinder extending laterally from said metal receiving station adjacent said table, and said fluid cylinder including a piston rod supporting an ejector head for movement across each said shot sleeve at said metal receiving station for removing a solidified metal biscuit from each said shot piston.

17. A die casting press as defined in claim 9 wherein said support member is supported by said frame for downward movement against said table in response to actuation of said power operated member for clamping the mold.

18. A die casting press as defined in claim 9 wherein each of said couplings comprises a set of horizontally spaced couplings members defining opposing undercut grooves.

19. A die casting press comprising a vertical frame, a table supported by said frame for rotary indexing on a generally vertical axis, a plurality of spaced shot sleeves supported by said table and having generally vertical and parallel spaced axes, a shot piston within each of said shot sleeves, a shot piston rod projecting downwardly from each of said shot pistons, a gate member positioned above said table for supporting a mold defining a cavity, a hydraulic clamping cylinder supported by said frame above said table for clamping the mold against said gate member, a power operated drive for rotating said table to present each of said shot sleeves to a metal transfer station under said gate member and then to a metal receiving station spaced horizontally from said metal transfer station, a hydraulic shot cylinder positioned under said metal transfer station and a hydraulic ejector cylinder positioned under said metal receiving station, each of said shot and ejector cylinders including an upwardly projecting piston rod, and means including laterally engagable and releasable couplings for alternately connecting each of said shot piston rods to said piston rods of said shot and ejector cylinders in response to indexing said table.

20. A die casting press as defined in claim 19 including means for preventing rotation of each said piston rod and the corresponding said coupling of said shot and ejector cylinders.

* * * * *